US012208987B2

(12) United States Patent
Yamazaki

(10) Patent No.: US 12,208,987 B2
(45) Date of Patent: Jan. 28, 2025

(54) WIRE BODY WINDING DEVICE AND WIRE BODY MANUFACTURING METHOD

(71) Applicant: SUMITOMO ELECTRIC INDUSTRIES, LTD., Osaka (JP)

(72) Inventor: Takashi Yamazaki, Osaka (JP)

(73) Assignee: SUMITOMO ELECTRIC INDUSTRIES, LTD., Osaka (JP)

( * ) Notice: Subject to any disclaimer, the term of this patent is extended or adjusted under 35 U.S.C. 154(b) by 280 days.

(21) Appl. No.: 17/774,920

(22) PCT Filed: Nov. 6, 2020

(86) PCT No.: PCT/JP2020/041620
§ 371 (c)(1),
(2) Date: May 6, 2022

(87) PCT Pub. No.: WO2021/090942
PCT Pub. Date: May 14, 2021

(65) Prior Publication Data

US 2022/0396453 A1 Dec. 15, 2022

(30) Foreign Application Priority Data

Nov. 7, 2019 (JP) ..... 2019-202154

(51) Int. Cl.
*B65H 67/00* (2006.01)
*B65H 57/04* (2006.01)
*B65H 67/04* (2006.01)

(52) U.S. Cl.
CPC ..... *B65H 67/0411* (2013.01); *B65H 57/04* (2013.01); *B65H 2701/32* (2013.01)

(58) Field of Classification Search
CPC ..... B65H 67/041; B65H 67/04; B65H 75/28; B65H 65/00; B65H 2701/31; B65H 2701/32; B65H 57/04
See application file for complete search history.

(56) References Cited

U.S. PATENT DOCUMENTS 2,785,867 A * 3/1957 Gallagher ..... B65H 65/00 242/474.5
2015/0008275 A1* 1/2015 Akamatsu ..... G02B 6/4457 242/476.6

FOREIGN PATENT DOCUMENTS

CN 107973190 A * 5/2018 ..... B65H 54/553
JP S50-068173 U 6/1975
JP S53-101032 U 8/1978
JP 2015-157665 A 9/2015

* cited by examiner

*Primary Examiner* — Emmanuel M Marcelo
(74) *Attorney, Agent, or Firm* — Faegre Drinker Biddle & Reath LLP

(57) ABSTRACT

A wire body winding device includes a rotating plate that rotates together with a drive shaft, a bobbin that is attached to the rotating plate and winds a wire body, and a locking portion that is attached to the rotating plate and locks the wire body. The locking portion includes a base member fixed to the rotating plate and a guide member disposed so as to overlap the base member. The locking portion has a base end portion at which the guide member is fixed to the base member and a tip end portion configured to receive the wire body. The locking portion has a shape in which a distance between the base member and the guide member increases gradually from the base end portion toward the tip end portion.

6 Claims, 7 Drawing Sheets

FIG. 7

ϕ200 (μm)

| | GRADIENT | SHIM THICKNESS (mm) | L (mm) | F1 | F2 | EVALUATION |
|---|---|---|---|---|---|---|
| SAMPLE 1 | 1 : 10 | 0.1 | | | | B |
| SAMPLE 2 | 1 : 10 | 0.15 | 9 | + | + | A |
| SAMPLE 3 | 1 : 50 | 0.15 | 9 | + | ± | A |
| SAMPLE 4 | 1 : 150 | 0 | 22 | + | + | A |
| SAMPLE 5 | 1 : 150 | 0.15 | 2.5 | + | ± | A |

FIG. 8

ϕ240 (μm)

| | GRADIENT | SHIM THICKNESS (mm) | L (mm) | F1 | F2 | EVALUATION |
|---|---|---|---|---|---|---|
| SAMPLE 6 | 1 : 20 | 0.1 | 11 | ± | − | B |
| SAMPLE 7 | 1 : 20 | 0.2 | 0 | ± | + | A |
| SAMPLE 8 | 1 : 50 | 0.15 | 10 | + | ± | A |
| SAMPLE 9 | 1 : 50 | 0.2 | 0 | + | + | A |
| SAMPLE 10 | 1 : 150 | 0 | 25 | + | + | A |
| SAMPLE 11 | 1 : 150 | 0.15 | 3.5 | + | + | A |

FIG. 9

ϕ330 (μm)

| | GRADIENT | SHIM THICKNESS (mm) | L (mm) | F1 | F2 | EVALUATION |
|---|---|---|---|---|---|---|
| SAMPLE 12 | 1 : 50 | 0.1 | 16 | + | ± | A |
| SAMPLE 13 | 1 : 50 | 0.15 | 12.5 | + | ± | A |
| SAMPLE 14 | 1 : 50 | 0.2 | 12 | + | ± | A |
| SAMPLE 15 | 1 : 150 | 0 | 34 | + | + | A |
| SAMPLE 16 | 1 : 150 | 0.15 | 14 | + | + | A |

WIRE BODY WINDING DEVICE AND WIRE BODY MANUFACTURING METHOD

TECHNICAL FIELD

The present disclosure relates to a wire body winding device and a wire body manufacturing method.

The present application claims priority from Japanese Patent Application No. 2019-202154 filed on Nov. 7, 2019, entire contents of which are incorporated by reference.

BACKGROUND ART

When an optical fiber is drawn, the optical fiber is wound around a bobbin by a winding device, and is continuously wound while the bobbin in which the optical fiber is fully wound is switched to another bobbin.

At this time, Patent Document 1 discloses a technique of locking the optical fiber to a locking portion attached to a rotating plate and switching a bobbin that winds the optical fiber.

CITATION LIST

Patent Literature

Patent Document 1: JP-A-2015-157665

SUMMARY OF INVENTION

A wire body winding device according to one aspect of the present disclosure includes:

- a rotating plate that rotates together with a drive shaft;
- a bobbin that is attached to the rotating plate and winds a wire body; and
- a locking portion that is attached to the rotating plate and locks the wire body,
- wherein the locking portion includes
  - a base member fixed to the rotating plate and
  - a guide member disposed so as to overlap the base member,
- the locking portion has a base end portion at which the guide member is fixed to the base member and a tip end portion configured to receive the wire body,
- the locking portion has a shape in which a distance between the base member and the guide member increases gradually from the base end portion toward the tip end portion.

A wire body manufacturing method according to one aspect of the present disclosure includes:

- locking a wire body by a locking portion provided on a rotating plate that rotates together with a drive shaft at a time of bobbin switching; and
- continuously winding the wire body while switching the bobbin that is detachably attached to the rotating plate,
- wherein the locking portion includes
  - a base member fixed to the rotating plate and
  - a guide member disposed so as to overlap the base member,
- the locking portion has a base end portion at which the guide member is fixed to the base member, and a tip end portion configured to receive the wire body, and
- a distance between the base member and the guide member increases gradually from the base end portion toward the tip end portion, and the wire body is held and locked between the base member and the guide member at the time of the bobbin switching. Even when the wire body have different thicknesses, the wire body can be locked without failure.

BRIEF DESCRIPTION OF DRAWINGS

FIG. 7 is a table illustrating evaluation results when a φ200 μm fiber is used.

FIG. 8 is a table illustrating evaluation results when a φ240 μm fiber is used.

FIG. 9 is a table illustrating evaluation results when a φ330 μm fiber is used.

DESCRIPTION OF EMBODIMENTS

Figure 1:
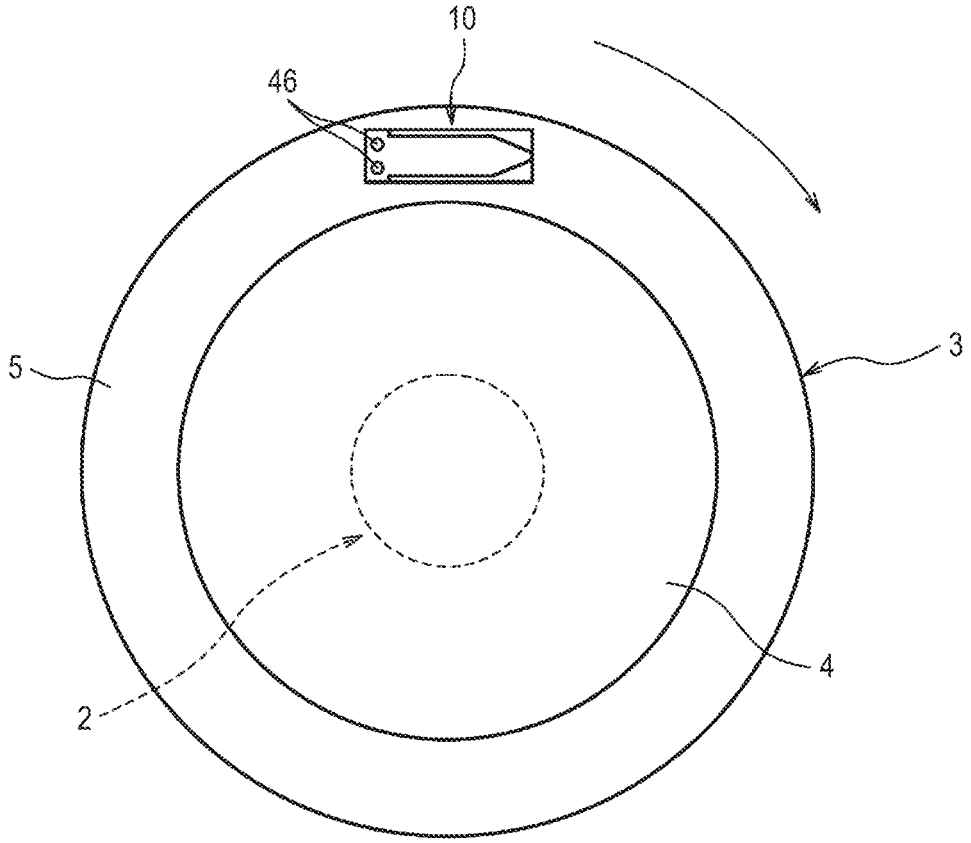
FIG. 1 is a configuration diagram of a rotating plate including a locking portion according to an aspect of the present disclosure.

Problems to be Solved by Present Disclosure

In recent years, the number of types of an optical fiber is increased, and a coating outer diameter is thicker during wire drawing, so that it is necessary to wind optical fibers having a wide range of thicknesses, from a small diameter fiber having a coating outer diameter of about 200 μm to a large diameter fiber having a coating outer diameter of about 330 μm. Therefore, regardless of the thickness of the optical fiber, it is desirable to prevent the optical fiber from coming off a locking portion or being flipped without entering the locking portion when the optical fiber is gripped by the locking portion.

The present disclosure has been made in view of the above circumstances, and an object of the present disclosure is to provide a wire body winding device and a wire body manufacturing method capable of locking wire bodies without failure even when the wire bodies have different thicknesses.

Effects of the Present Disclosure

According to the present disclosure, even when the wire bodies have different thicknesses, the wire bodies can be locked without failure.

Description of Embodiments of the Present Disclosure

First, contents of embodiments of the present disclosure will be listed and described.

(1) A wire body winding device according to the present disclosure includes:

- a rotating plate that rotates together with a drive shaft;
- a bobbin that is attached to the rotating plate and winds a wire body; and
- a locking portion that is attached to the rotating plate and locks the wire body,
- wherein the locking portion includes
  - a base member fixed to the rotating plate and
  - a guide member disposed so as to overlap the base member, the locking portion has a base end portion at which the guide member is fixed to the base member and a tip end portion configured to receive the wire body, the locking portion has a shape in which a distance between the base member and the guide member increases gradually from the base end portion toward the tip end portion.

Since the locking portion has the shape in which the distance between the base member and the guide member increases gradually from the base end portion toward the tip end portion, a wire body having a large diameter can be gripped closer to the tip end portion, and a wire body having a smaller diameter can be gripped closer to the base end portion. As a result, even when the wire bodies have different thicknesses, the wire body can be locked without failure.

(2) In one aspect of the wire body winding device of the present disclosure, the guide member has a gradient in which the distance between the base member and the guide member increases from the base end portion toward the tip end portion. Since the guide member is provided with the gradient, it is only necessary to change the guide member to adjust an increase of the distance between the base member and the guide member. Therefore, a degree of the increase can be easily adjusted as compared with a case where the base member fixed to the rotating plate is provided with the gradient.

(3) In one aspect of the wire body winding device of the present disclosure, a thickness of the guide member is thinner from the base end portion toward the tip end portion.

According to such a configuration, the gradient can be easily provided by changing the thickness of the guide member.

(4) In one aspect of the wire body winding device of the present disclosure, the base member and the guide member are made of metal. When the base member and the guide member are made of metal, it is not necessary to consider a deformation of the base member when the wire body is gripped, so that the wire bodies having different thicknesses can be reliably gripped.

(5) In one aspect of the wire body winding device of the present disclosure, the guide member includes a facing surface facing the base member, and the facing surface includes: a contact region that is contactable with the wire body, and inclined surface regions that are provided on both sides of the contact region in a direction intersecting with a direction from the base end portion toward the tip end portion and that have an inclination away from the base member as being away from the contact region. Since the inclined surface regions are less likely to come into contact with the wire body, a load on the wire body is prevented.

(6) In one aspect of the wire body winding device of the present disclosure, the base member and the guide member are separated by a given gap at a starting point where the distance between the base member and the guide member increases, which is located at an end of the base end portion. A gap is provided at a position where the distance between the base member and the guide member begins to increase, lengthening of the locking portion can be avoided, and a compact locking portion can be provided.

(7) In one aspect of the wire body winding device of the present disclosure, the gradient of the guide member with respect to the base member is 1/30 or less. The wire bodies having different thicknesses can be more reliably gripped by the same locking portion.

(8) A wire body manufacturing method according to the present disclosure includes: locking a wire body by a locking portion provided on a rotating plate that rotates together with a drive shaft at a time of bobbin switching; and continuously winding the wire body while switching the bobbin that is detachably attached to the rotating plate, wherein the locking portion includes a base member fixed to the rotating plate and a guide member disposed so as to overlap the base member, the locking portion (1) has a base end portion (24, 44) at which the guide member is fixed to the base member, and a tip end portion configured to receive the wire body, and a distance between the base member and the guide member increases gradually from the base end portion toward the tip end portion, and the wire body is held and locked between the base member and the guide member at the time of the bobbin switching. Even when the wire bodies have different thicknesses, the wire bodies can be locked without failure.

Details of Embodiments of Present Disclosure

Hereinafter, preferred embodiments of the wire body winding device and the wire body manufacturing method according to the present disclosure will be described with reference to the accompanying drawings.

FIG. 1 is a configuration diagram of the rotating plate including a locking portion 10 according to an aspect of the present disclosure. A winding device includes a claw wheel 3 that rotates together with the drive shaft (not shown). The claw wheel 3 corresponds to the rotating plate of the present disclosure.

The claw wheel 3 includes a bobbin accommodating portion 4 having a circular shape and a flange-shaped portion 5 made of, for example, aluminum, which is formed on an outer periphery of the bobbin accommodating portion 4. A bobbin 2 is detachably attached to the bobbin accommodating portion 4, and the locking portion 10 is fixed to the flange-shaped portion 5 by, for example, two hexagon socket head bolts 46.

The locking portion 10 can be locked by hooking the wire body such as an optical fiber, an electric wire/cable with a small diameter, or the like. The winding device is configured to be able to switch the bobbin in which the wire body is fully wound to another bobbin, and also includes another claw wheel that is capable of attaching the other bobbin to another position. The locking portion having the same function as the locking portion 10 is provided in the flange-shaped portion of the other claw wheel.

Figure 2:
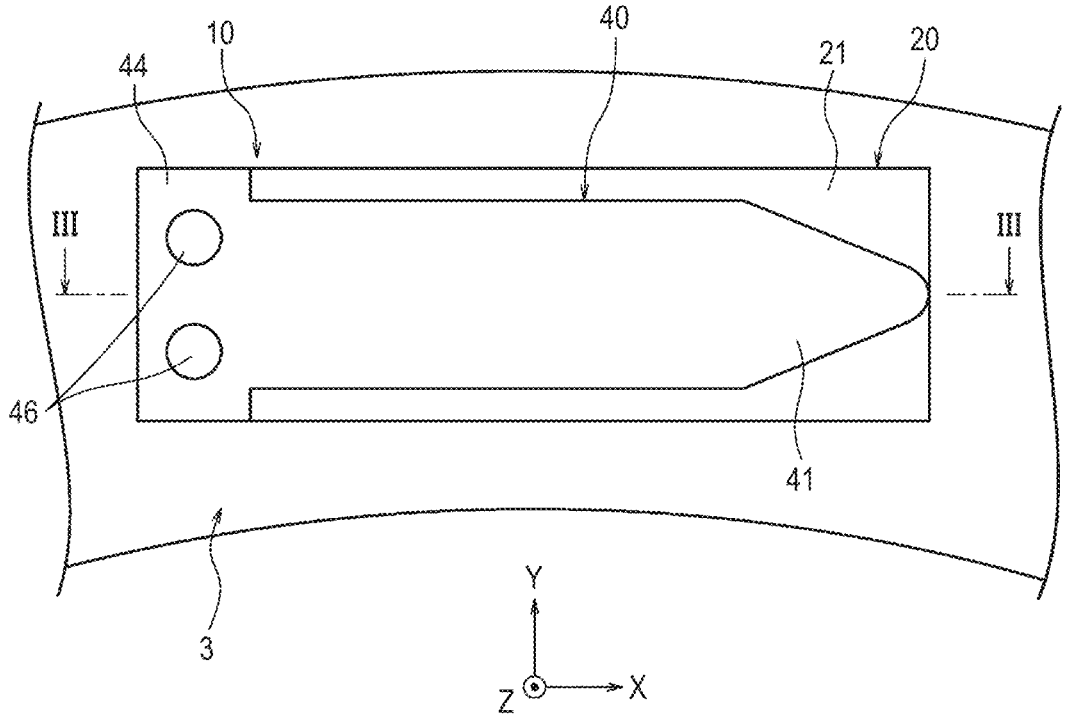
FIG. 2 is a view illustrating the locking portion.
Figure 3:
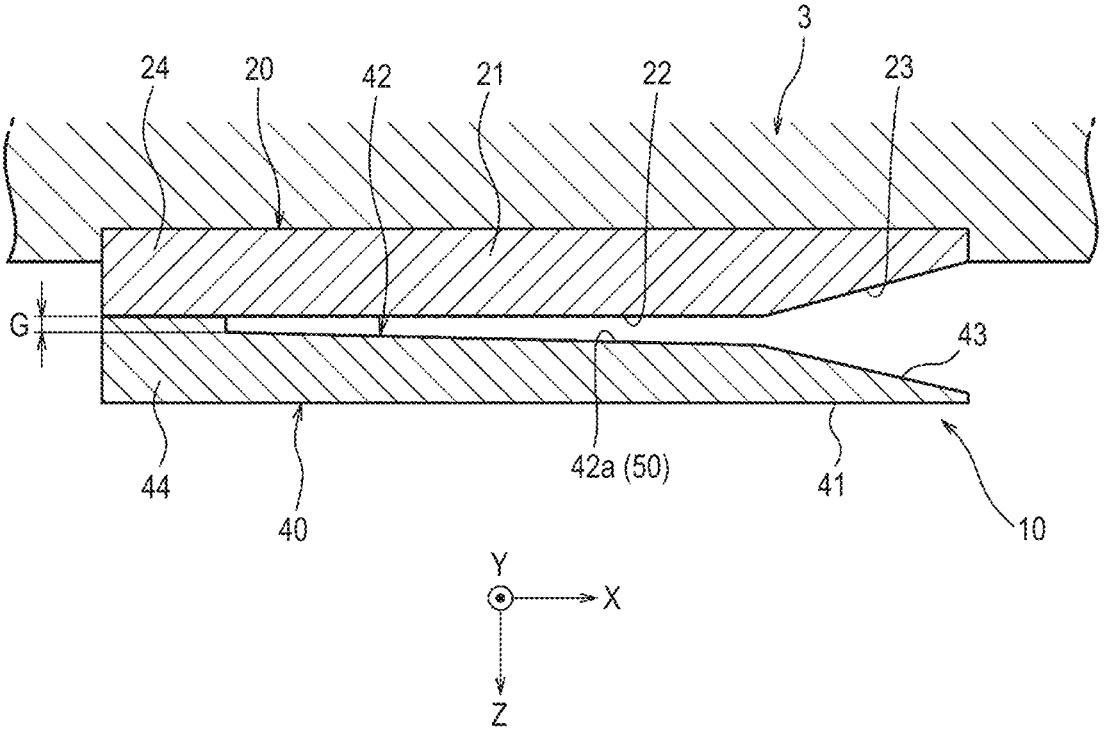
FIG. 3 is a cross-sectional view taken along a line in FIG. 2.
Figure 4:
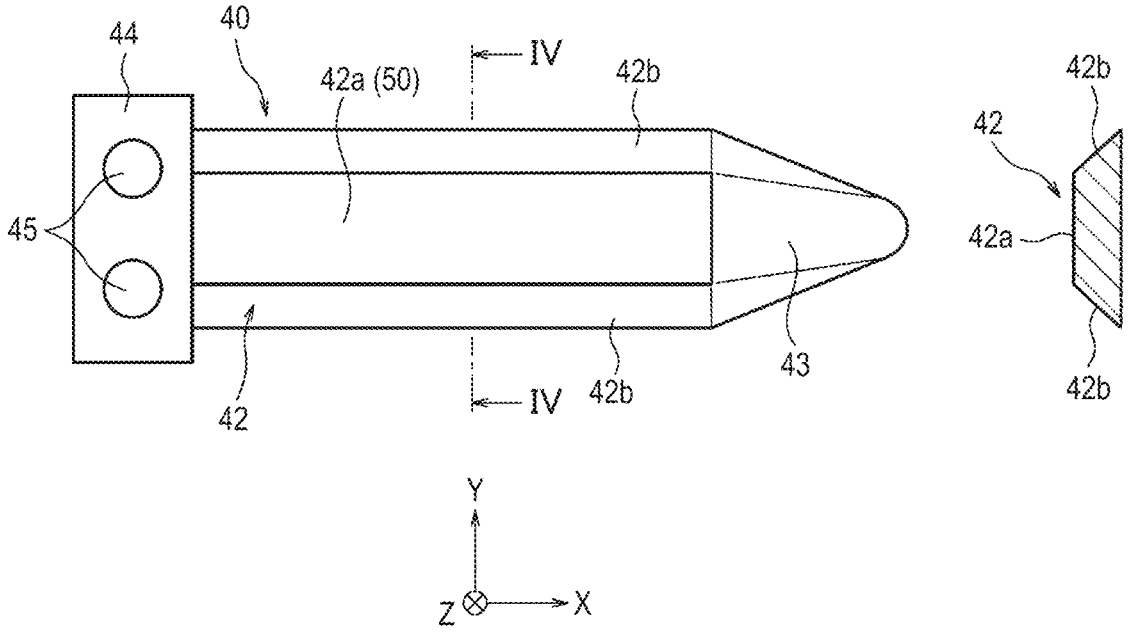
FIG. 4 is a view illustrating a guide member.

FIG. 2 is a view illustrating the locking portion 10, FIG. 3 is a cross-sectional view taken along a line in FIG. 2, and FIG. 4 is a view illustrating a guide member 40.

The locking portion 10 includes a base member 20 and the guide member 40 disposed so as to overlap the base member 20.

The base member 20 includes a base body 21 made of, for example, stainless steel (SUS304). As shown in FIG. 3, the base body 21 is embedded in the flange-shaped portion 5 of the claw wheel 3 in a state where a front surface 22 is exposed. The front surface 22 faces a facing surface 42 of the guide member 40. As viewed in a rotation direction (indicated by an arrow in FIG. 1) of the claw wheel 3, a first taper 23 of the base member is formed on a front side of the front surface 22, and a fixing portion 24 of the base member is provided on a rear side of the front surface 22. The first taper 23 of the base member corresponds to the tip end portion of the present disclosure, and the fixing portion 24 of the base member corresponds to the base end portion of the present disclosure.

The first taper 23 of the base member is inclined so as to approach the guide member 40 as advancing from a front end portion of the front surface 22 to a center position of the front surface 22, and is used for guiding the wire body. The front surface 22 and the first taper 23 of the base member are subjected to, for example, alumite treatment in order to obtain abrasion resistance. Bolt holes 45 for the hexagon socket head bolts 46 are provided so as to penetrate the fixing portion 24 of the base member, although the bolt holes 45 are not visible at a cross-sectional position of FIG. 3.

The guide member 40 is made of, for example, stainless steel (SUS304). The guide member 40 includes a tip end claw 41 that guides the wire body, and the locking portion 10 rotates together with the claw wheel 3. As shown in FIG. 3, the tip end claw 41 includes a first taper 43 of the guide member at a position facing the first taper 23 of the base member. The first taper 43 of the guide member also corresponds to the tip end portion of the present disclosure. The first taper 43 of the guide member is inclined so as to approach the base member 20 as advancing from a front end portion of the facing surface 42 to a center position of the facing surface 42, and is used for guiding the wire body. The facing surface 42 and the first taper 43 of the guide member are also subjected to, for example, the alumite treatment.

A fixing portion 44 of the guide member is provided in a rear side of the facing surface 42 when viewed in the rotation direction of the claw wheel 3, and as shown in FIG. 2, the bolt holes 45 for the hexagon socket head bolts 46 are formed so as to penetrate the fixing portion 44 of the guide member. The fixing portion 44 of the guide member also corresponds to the base end portion of the present disclosure. In the fixing portion 44 of the guide member, the guide member 40 is fixed to the base member 20.

As shown in FIG. 3, the guide member 40 has, for example, a stepped shape, and the facing surface 42 is formed at a position lower by one step than the fixing portion 44 of the guide member (separated from the base member). Thus, when viewed in a thickness direction of the guide member 40 (the same as a Z direction in FIGS. 2 and 3), the base member 20 and the guide member 40 are separated by a gap G (for example, about 0.1 mm). That is, the gap G is provided at the starting point where the distance between the base member 20 and the guide member 40 increases, which is located at the end of the base end portion. When the gradient described later is gentle, the locking portion 10 is longer, the locking portion 10 may be difficult to fit in the claw wheel 3, but when the gap G is provided as described above, the locking portion 10 can be shortened even when the gradient is gentle.

In the present embodiment, an example in which the guide member 40 is formed in the stepped shape is described. However, the present disclosure is not limited to this example. In order to obtain the gap G, for example, instead of the guide member 40 having a stepped shape, the guide member 40 may have the fixing portion 44 of the guide member and the facing surface 42 flush with each other, and a shim may be sandwiched between the fixing portion 24 of the base member and the fixing portion 44 of the guide member.

The facing surface 42 includes a contact region 42*a* that is contactable with the wire body. The contact region 42*a* is formed to have a given width in a width direction of the guide member 40 (the same as a Y direction in FIGS. 2 and 3), and extends in a length direction of the guide member 40 (the same as an X direction in FIGS. 2 and 3). The distance between the base member 20 and the guide member 40 is set to gradually increase. Specifically, for example, a second taper 50 is provided in the contact region 42*a*. A degree of inclination of the second taper 50 corresponds to the gradient of the present disclosure. The second taper 50 is formed so as to gradually increase the distance between the base member 20 and the guide member 40 from the fixing portion 44 of the guide member toward the first taper 43 of the guide member. That is, the locking portion 10 has the shape in which the distance between the base member 20 and the guide member 40 increases gradually from the base end portion toward the tip end portion. The thickness of the guide member 40 may be thinner from the base end portion toward the tip end portion. The second taper 50 is formed more gently than the first taper 43 of the guide member.

Specifically, the second taper 50 is set in a range of 1:200 (0.5% gradient) or more to 1:50 (2% gradient) or less. In an example of the former 1:200 (0.5% gradient), this gradient corresponds to a case that the thickness direction of the guide member 40 (the same as the Z direction in FIGS. 2 and 3) is 1, and the length direction of the guide member 40 (the same as the X direction in FIGS. 2 and 3) is 200.

By providing the second taper 50 described above, even when the wire bodies have different thicknesses, the wire bodies can be gripped by the same locking portion 10 without failure.

Further, since the guide member 40 is provided with the second taper 50, it is only necessary to change the guide member 40 to adjust the gradient. Therefore, the gradient can be easily adjusted as compared with a case where the base member 20 fixed to the rotating plate is provided with a taper.

The base member 20 and the guide member 40 are made of metal. When the base member 20 is made of an elastic body, for example, in a case of the wire body having a small diameter, the base member 20 is less deformed, so that a gripping force is small, and in a case of the wire body having a large diameter, even when the base member 20 is deformed, it is difficult for the wire body to enter an inner side, and locking is easily failed. On the other hand, if the base member 20 and the guide member 40 are made of metal as described above, the base member 20 is not deformed when gripping the wire body, so that the wire bodies having different thicknesses can be reliably gripped by the same strength.

As shown in FIG. 4, the facing surface 42 has inclined surface regions 42*b*. The inclined surface regions 42*b* are provided on both sides of the contact region 42*a*, respectively, in an intersecting direction (the same as the Y direction in FIGS. 2 to 4) with respect to the direction from the fixing portion 44 of the guide member toward the first taper 43 of the guide member. The inclined surface regions 42*b* have an inclination away from the front surface 22 of the base member 20 as being away from the contact region 42*a*. As a result, the inclined surface regions 42*b* are less likely to come into contact with the wire body, and thus the load on the wire body is prevented.

Figure 5:
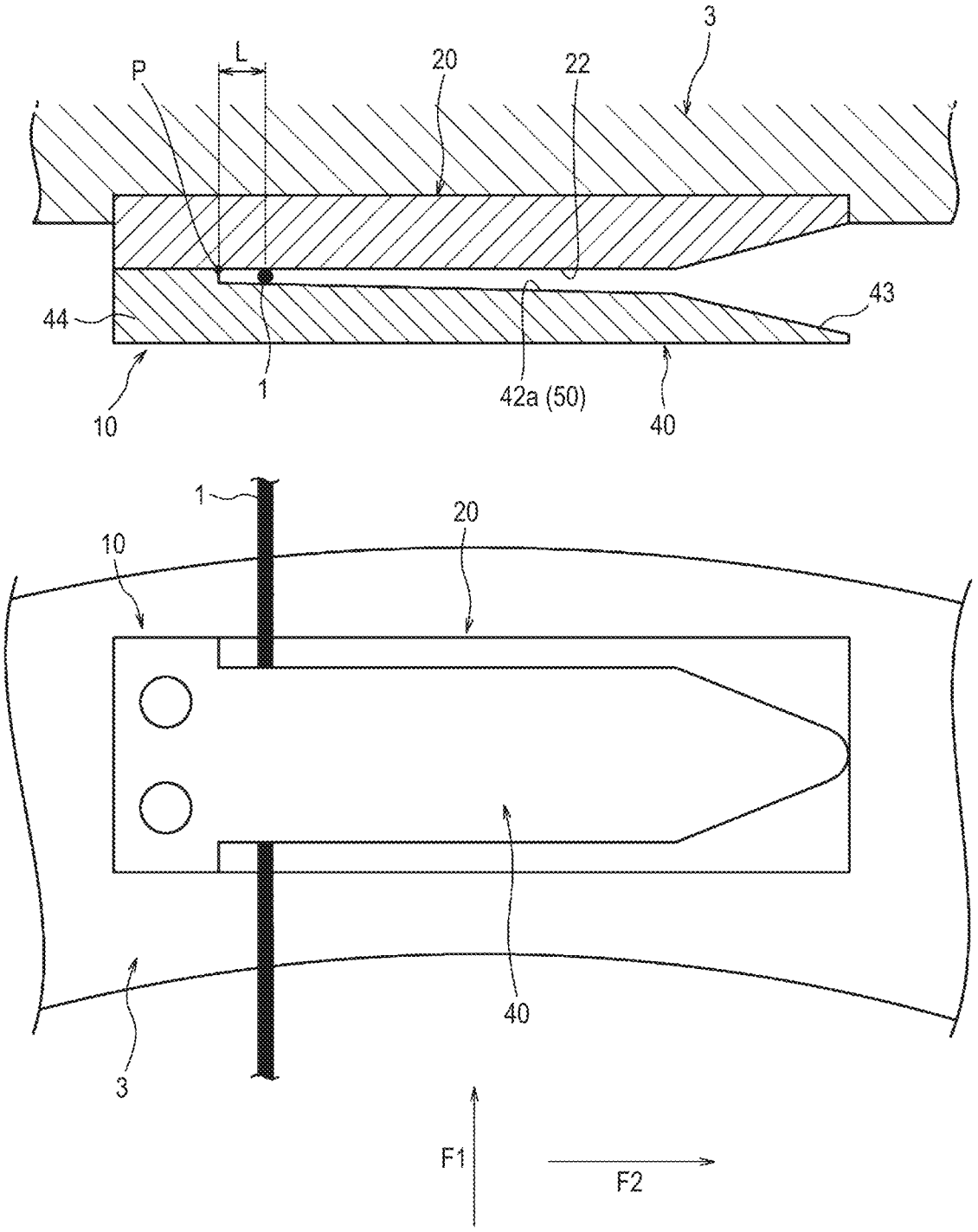
FIG. 5 illustrates views of a state in which a thin wire body is gripped by the locking portion.
Figure 6:
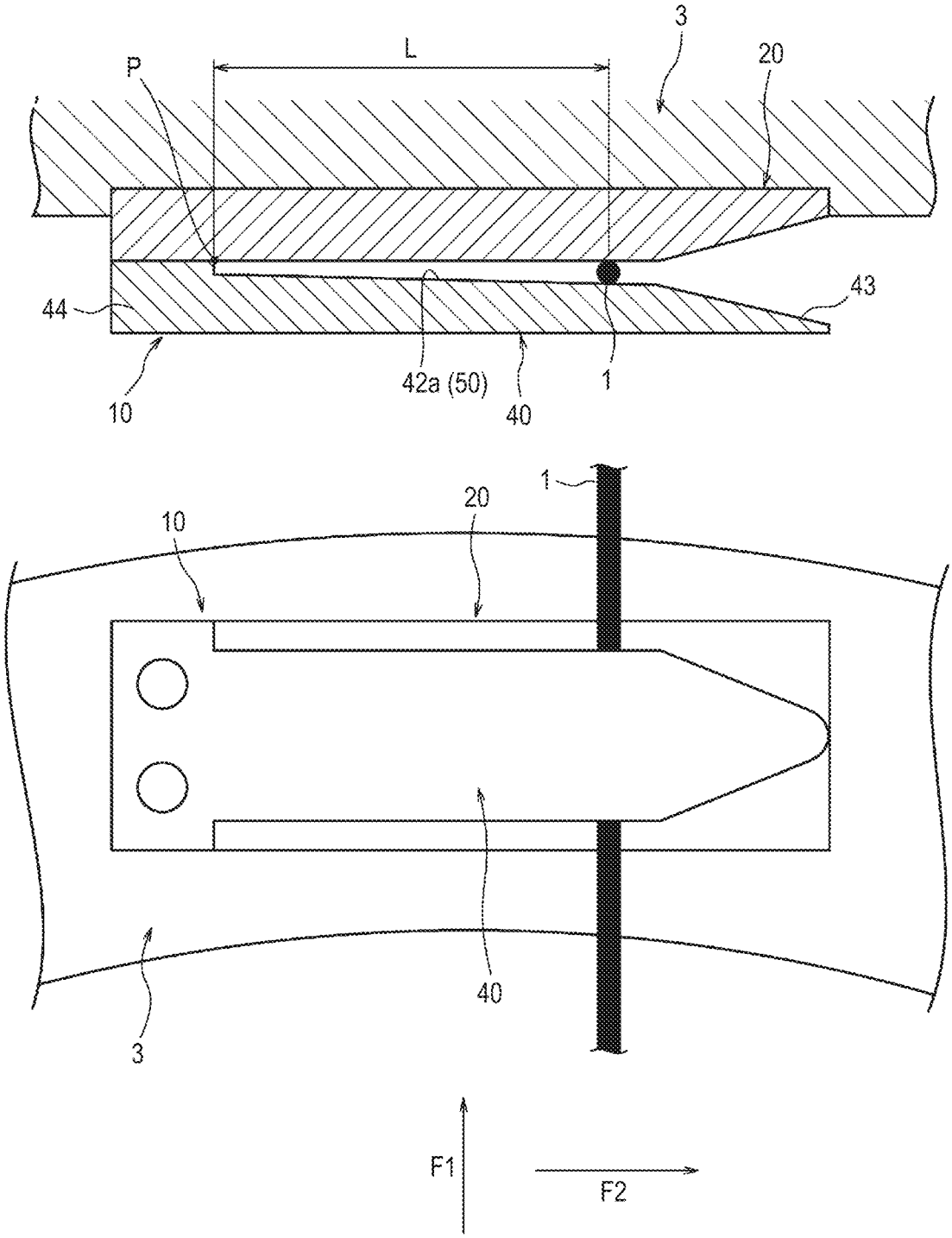
FIG. 6 illustrates views of a state in which a thick wire body is gripped by the locking portion.

FIGS. 5 and 6 are views illustrating a state in which a wire body 1 is gripped by the locking portion 10.

The wire body 1 enters the locking portion 10 by rotation of the claw wheel 3. In a state in which the wire body 1 travels in the width direction of the guide member 40 (the same as the Y direction in FIGS. 2 to 4), the wire body 1 is received by the first taper 23 of the base member and the first taper 43 of the guide member, passes between the contact region 42*a* and the front surface 22, and travels toward the fixing portion 24 of the base member and the fixing portion 44 of the guide member.

In the case of the wire body 1 having a small diameter, as shown in FIG. 5, the wire body 1 having a small diameter is gripped in contact with both the base member 20 (front surface 22) and the guide member 40 (contact region 42*a*) at a position closer to the fixing portion 44 of the guide member. On the other hand, in the case of the wire body 1 having a large diameter, as shown in FIG. 6, the wire body 1 having a large diameter is gripped in contact with both the base member 20 and the guide member 40 at a position closer to the first taper 43 of the guide member.

Assuming that a boundary position between the fixing portion 44 of the guide member and the contact region 42*a* is a reference position P, the wire body 1 is gripped at a bite position separated by a distance L from the reference position P. In the case of the wire body 1 having a large diameter (FIG. 6), the distance L to the bite position is longer than in the case of the wire body 1 having a small diameter (FIG. 5).

Next, the gradient of the second taper 50 was changed, and a gripping state of the wire body 1 gripped by the locking portion 10 was observed and evaluated.

More specifically, both sides of the wire body 1 are held by a hand, pressed into the locking portion 10 from the first taper 43 of the guide member toward the fixing portion 44 of the guide member with a substantially constant force, and gripped by the locking portion 10. Thereafter, a force in the Y direction shown in FIGS. 2 to 4 was applied to the wire body 1 gripped by the locking portion 10, and a force required to pull out the wire body 1 from the locking portion 10 (hereinafter referred to as a pull-out force F1) was measured. Next, after the wire body 1 was similarly pressed into the locking portion 10, a force in the X direction shown in FIGS. 2 to 4 was applied to the wire body 1 gripped by the locking portion 10, and a force required to return and pull out the wire body 1 from the locking portion 10 (hereinafter referred to as a return pull-out force F2) was measured. F1 and F2 were measured in three stages of a state where the wire body is sufficiently gripped (expressed as a "great force"), a state where the wire body is immediately pulled out (expressed as a "small force"), or in the middle thereof (expressed as a "medium force"), and the forces are indicated by "+", "−", and "±" in FIGS. 7 to 9, respectively.

As shown in FIG. 7, for the wire body 1 having an outer diameter of φ200 μm, when the second taper 50 was set to 1:10 (10% gradient) and a shim thickness was 0.1 mm (referred to as a sample 1), since the wire body 1 cannot be gripped by the locking portion 10, the distance L to the bite position cannot be measured, and neither the pull-out force F1 nor the return pull-out force F2 can be measured. Therefore, it was determined that the sample 1 was not suitable for gripping the wire body (Evaluation B).

On the other hand, when the gradient was the same as that of the sample 1 and a shim having a thickness of 0.15 mm was sandwiched (referred to as a sample 2), the distance L to the bite position was 9 mm, a large force was required for F1, and the wire body was firmly gripped. In addition, a large force was also required for F2, and the wire body was firmly gripped. Therefore, it was determined that the sample 2 was suitable for gripping the wire body (Evaluation A).

As described above, when the second taper 50 was set to 1:10, some samples such as the sample 1 may not be determined to be the evaluated A, and the evaluation varied.

For the wire body 1 having the same outer diameter of φ200 μm, when the second taper 50 was set to 1:50 (2% gradient) (referred to as a sample 3), the distance L to the bite position was 9 mm, a large force was required for F1 and a medium force was required for F2, and it was determined that the sample 3 was suitable for gripping the wire body (Evaluation A).

In addition, for the wire body 1 having the same outer diameter of φ200 μm, when the second taper 50 was set to 1:150 (0.67% gradient) (referred to as a sample 4), the distance L to the bite position was 22 mm, a large force was required for F1 and a large force was also required for F2, and it was determined that the sample 4 was suitable for gripping the wire body (Evaluation A). In addition, although the sample 4 does not sandwich the shim, when the shim having a thickness of 0.15 mm was sandwiched (referred to as a sample 5), the distance L to the bite position was 2.5 mm, a large force was required for F1 and a medium force was required for F2, and it was determined that the sample 5 was suitable for gripping the wire body (Evaluation A). In the wire body 1 having an outer diameter of φ200 μm, when the second taper 50 was 1:150, although the sample was suitable for gripping the wire body regardless of a presence or absence of the shim, when there is no shim, the distance to the bite position is longer, and a long guide member is required.

Although a representation is omitted, for the wire body 1 having the same outer diameter of φ200 μm, when the second taper 50 was set to 1:200 (0.5% gradient), a large force was required for F1 and a large force was also required for F2, it was determined that the sample was suitable for gripping the wire body (Evaluation A), but a longer guide member than that in a case of 1:150 was required.

As shown in FIG. 8, for the wire body 1 having an outer diameter of φ240 μm, when the second taper 50 was set to 1:20 (5% gradient) (referred to as a sample 6), the distance L to the bite position was 11 mm. In this case, the shim having a thickness of 0.1 mm is sandwiched. In the case of the sample 6, a medium force was required for F1, but a small force was required for F2. Therefore, it was determined that the sample 6 was not suitable for gripping the wire body (Evaluation B).

In the wire body 1 having the same outer diameter, when the gradient was set to be the same as that of the sample 6 and the thickness of the shim was set to 0.2 mm (referred to as a sample 7), the distance L to the bite position was 0 mm, a medium force was required for F1 and a large force was required for F2, and it was determined that the sample 7 was suitable for gripping the wire body (Evaluation A).

As described above, when the second taper 50 was set to 1:20, the evaluation varied.

For the wire body 1 having the same outer diameter of φ240 μm, when the second taper 50 was set to 1:50 (2% gradient) (referred to as a sample 8), and the shim having a thickness of 0.15 mm was sandwiched, the distance L to the bite position was 10 mm, a large force was required for F1 and a medium force was required for F2, and it was determined that the sample 8 was suitable for gripping the wire body (Evaluation A). In the wire body 1 having the same outer diameter, when the gradient was set to be the same as that of the sample 8 and the thickness of the shim was set to 0.2 mm (referred to as a sample 9), the distance L to the bite position was 0 mm, a large force was required for F1 and a large force was also required for F2, and it was determined that the sample 9 was suitable for gripping the wire body (Evaluation A).

For the wire body 1 having the same outer diameter of φ240 μm, when the second taper 50 was set to 1:150 (0.67% gradient) (referred to as a sample 10), the distance L to the bite position was 25 mm, a large force was required for F1 and a large force was also required for F2, and it was determined that the sample 10 was suitable for gripping the wire body (Evaluation A). Although the sample 10 does not sandwich the shim, when the shim having a thickness of 0.15 mm was sandwiched (referred to as a sample 11), the distance L to the bite position was 3.5 mm, a large force was required for F1 and a large force was also required for F2, and it was determined that the sample 11 was suitable for gripping the wire body (Evaluation A). In the wire body 1 having an outer diameter of φ240 μm, when the second taper 50 was 1:150, although the sample was suitable for gripping the wire body regardless of the presence or absence of the shim, when there is no shim, the distance to the bite position is longer, and the long guide member is required.

As shown in FIG. 9, for the wire body 1 having an outer diameter of φ330 μm, when the second taper 50 was set to 1:50 (2% gradient) (referred to as a sample 12), the distance L to the bite position was 16 mm. In this case, the shim having a thickness of 0.1 mm is sandwiched. In the case of the sample 12, a large force was required for F1 and a medium force was required for F2, and it was determined that the sample 12 was suitable for gripping the wire body (Evaluation A).

In the wire body 1 having the same outer diameter, when the gradient was set to be the same as that of the sample 12 and the thickness of the shim was set to 0.15 mm (referred to as a sample 13), the distance L to the bite position was 12.5 mm, a medium force was required for F1 and a large force was required for F2, and it was determined that the sample 13 was suitable for gripping the wire body (Evaluation A). Further, when the thickness of the shim was set to 0.2 mm (referred to as a sample 14), the distance L to the bite position was 12 mm, a large force was required for F1 and a medium force was required for F2, and it was determined that the sample 14 was suitable for gripping the wire body (Evaluation A).

For the wire body 1 having the same outer diameter of φ330 μm, when the second taper 50 was set to 1:150 (0.67% gradient) (referred to as a sample 15), the distance L to the bite position was 34 mm, a large force was required for F1 and a large force was also required for F2, and it was determined that the sample 15 was suitable for gripping the wire body (Evaluation A). Although the sample 15 does not sandwich the shim, when the shim having a thickness of 0.15 mm was sandwiched (referred to as a sample 16), the distance L to the bite position was 14 mm, a large force was required for F1 and a large force was also required for F2, and it was determined that the sample 16 was suitable for gripping the wire body (Evaluation A). In the wire body 1 having an outer diameter of φ330 μm, when the second taper 50 was 1:150, although the sample was suitable for gripping the wire body regardless of the presence or absence of the shim, when there is no shim, the distance to the bite position is longer, and the long guide member is required.

Although a representation is omitted, for the wire body 1 having the same outer diameter of φ330 μm, when the second taper 50 was set to 1:200 (0.5% gradient), a large force was required for F1 and a large force was also required for F2, it was determined that the sample was suitable for gripping the wire body (Evaluation A), but a longer guide member than that in a case 1:150 was required.

Therefore, when the second taper 50 is set in a range of 1:200 to 1:50, it is understood that the wire bodies having different thicknesses can be reliably gripped by the same locking portion 10.

In the above embodiment, the gradient was formed by providing the second taper 50 in the guide member 40. However, in the present disclosure, it is also possible to form a desired gradient by providing the taper in the base member 20, or to form the desired gradient by providing the taper in both the base member 20 and the guide member 40.

It should be understood that the embodiments disclosed herein are illustrative and non-restrictive in every respect. The scope of the present disclosure is defined not by the above description but by the scope of the claims, and is intended to include all modifications within the meaning and scope equivalent to the scope of the claims.

REFERENCE SIGNS LIST

1 . . . wire body
2 . . . bobbin
3 . . . claw wheel (rotating plate)
4 . . . bobbin accommodating portion
5 . . . flange-shaped portion
10 . . . locking portion
20 . . . base member
21 . . . base body
22 . . . front surface
23 . . . first taper (tip end portion) of base member
24 . . . fixing portion (base end portion) of base member
40 . . . guide member
41 . . . tip end claw
42 . . . facing surface
42*a* . . . contact region
42*b* . . . inclined surface region
43 . . . first taper (tip end portion) of guide member
44 . . . fixing portion (base end portion) of guide member
45 . . . bolt hole
46 . . . hexagon socket head bolt
50 . . . second taper (gradient)
G . . . gap
F1 . . . pull-out force
F2 . . . return pull-out force
P . . . reference position
L . . . distance to bite position

The invention claimed is:

1. An optical fiber winding device, comprising:
a rotating plate that rotates together with a drive shaft;
a bobbin that is attached to the rotating plate and winds an optical fiber; and
a locking portion that is attached to the rotating plate and locks the optical fiber,
wherein the locking portion includes
a base member fixed to the rotating plate and
a guide member disposed so as to overlap the base member,
the locking portion has a base end portion at which the guide member is fixed to the base member and a tip end portion configured to receive the optical fiber,
the guide member has a gradient in which the distance between the base member and the guide member increases from the base end portion toward the tip end portion,
the base member has a flat portion with no gradient,
the locking portion has a shape in which a distance between the base member and the guide member increases gradually from the base end portion toward the tip end portion, and
the gradient of the guide member with respect to the base member is 1/200 or more and 1/50 or less.

2. The optical fiber winding device according to claim 1, wherein a thickness of the guide member is thinner from the base end portion toward the tip end portion.

3. The optical fiber winding device according to claim 1, wherein the base member and the guide member are made of metal.

4. The optical fiber winding device according to claim 1, wherein the guide member includes a facing surface facing the base member, and wherein the facing surface includes:

a contact region that is contactable with the optical fiber, and inclined surface regions that are provided at both sides of the contact region in a direction intersecting with a direction from the base end portion toward the tip end portion and that have an inclination away from the base member as being away from the contact region.

5. The optical fiber winding device according to claim 1, wherein the base member and the guide member are separated by a given gap at a starting point where the distance between the base member and the guide member increases, which is located at an end of the base end portion.

6. An optical fiber manufacturing method, comprising:

locking an optical fiber by a locking portion provided on a rotating plate that rotates together with a drive shaft at a time of bobbin switching; and continuously winding the optical fiber while switching the bobbin that is detachably attached to the rotating plate, wherein the locking portion includes a base member fixed to the rotating plate and a guide member disposed so as to overlap the base member, the locking portion has a base end portion at which the guide member is fixed to the base member, and a tip end portion configured to receive the optical fiber, the guide member has a gradient in which the distance between the base member and the guide member increases from the base end portion toward the tip end portion, the base member has a flat portion with no gradient, the gradient of the guide member with respect to the base member is 1/200 or more and 1/50 or less, and a distance between the base member and the guide member increases gradually from the base end portion toward the tip end portion, and the optical fiber is held and locked between the base member and the guide member at the time of the bobbin switching.

* * * * *